United States Patent [19]

Bush et al.

[11] 4,043,089

[45] Aug. 23, 1977

[54] OVERLAP CLOSURE SYSTEM FOR PRECAST PRESTRESSED WATER TANKS

[75] Inventors: Bill R. Bush, West Babylon; Jack Hornstein, Old Bethpage, both of N.Y.

[73] Assignee: Preload Company, Inc., Garden City, N.Y.

[21] Appl. No.: 636,729

[22] Filed: Dec. 1, 1975

[51] Int. Cl.[2] ..... E04D 1/00; E04C 3/10

[52] U.S. Cl. ..... 52/516; 52/223 R; 52/227; 52/285; 52/295; 52/405

[58] Field of Search ..... 52/516, 518, 224, 227, 52/259, 285, 293, 295, 396, 447, 453, 596, 747, 405, 612, 223

[56] References Cited

U.S. PATENT DOCUMENTS

| | | | |
|---|---|---|---|
| 1,221,151 | 4/1917 | Davis | 52/516 |
| 1,467,121 | 9/1923 | Smith et al. | 52/405 |
| 2,329,719 | 9/1943 | Hewett | 52/612 |
| 3,217,451 | 11/1965 | Closner | 52/224 |
| 3,226,896 | 1/1966 | Bothe et al. | 52/518 |
| 3,280,525 | 10/1966 | Crowley | 52/227 X |
| 3,334,162 | 8/1967 | Lauffer et al. | 52/224 |
| 3,466,827 | 9/1969 | Clem | 52/516 |

*Primary Examiner*—Price C. Faw, Jr.
*Assistant Examiner*—Robert C. Farber
*Attorney, Agent, or Firm*—Curtis, Morris & Safford

[57] ABSTRACT

A prestressed concrete tank having a core wall comprising elongated panels of precast concrete having on their outer face a sheet of sheet metal presenting parallel, longitudinal, undercut channels, is shown. The precast panels are assembled and spaced, in side-by-side relationship. Two, laterally extending metal flanges which run parallel with the elongated sides of the panels are provided. The flanges on adjacent panels overlap one another and are fastened by means of sheet metal screws. The joint formed is sealed with an elastomeric material. The advantages of the tank configuration are that expensive cover plates as have heretofore been used are avoided and the joinery is reduced by approximately one half thereby reducing the cost of sealant material and the labor required to apply it, as well as substantially reducing the likelihood of leakage from the tank.

3 Claims, 3 Drawing Figures

OVERLAP CLOSURE SYSTEM FOR PRECAST PRESTRESSED WATER TANKS

Figure 1:
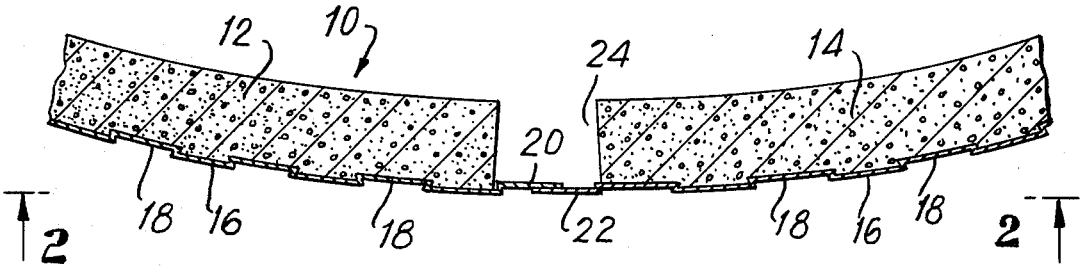

This invention comprises a concrete tank of improved structure which is easy to assemble on-site from precast concrete units. More specifically, this invention relates to prestressed concrete tanks wherein the concrete core wall is comprised of elongated precast concrete panels having an outer facing of steel sheet. Even more specifically, this invention relates to a novel and economical method for connecting adjacent precast concrete panels to form an integrated assembly having reliable, water tight joints.

Concrete tanks have heretofore been erected from the ground up at the work site. This method of operation is inefficient because work is subjected to delays due to weather, unavailability of materials of labor, etc. Efforts have therefore been made to bring to the work site, precast concrete units which can be fabricated at convenient times and places and typically indoors.

The precast panels typically include a sheet metal sheathing which is permanently bonded to one face of a precast concrete panel. The sheathing presents a plurality of parallel, longitudinal channels which form a site upon which mortar may be projected to form an outer coating or wall on the erected panels. Typically, these precast units are formed of hydraulic concrete deposited upon a sheet steel diaphragm in which the parallel, longitudinal channels have already been formed, the panels being of a length in accordance with the height of the contemplated tank.

While the advent of precast concrete panels has simplified the on-site erection of prestressed concrete tanks, problems have been encountered in connecting and sealing the precast units to one another. U.S. Pat. No. 3,280,525, to Crowley suggests a technique for connecting and sealing precast panels to one another wherein a half channel is formed on both edges of each precast panel so that adjacent panels present one full channel which can be locked in place by the insertion of a metal key plate having a cross section similar to that of the channels but just slightly smaller in size so as to fit snuggly when driven in place.

The primary object of this invention is to provide a simpler, more economical and more reliable method and precast panel configuration so that precast concrete panels having sheet steel outer facings with parallel, longitudinal undercut channels may be more efficiently connected to one another in the erection of the precast concrete tank.

It is also an object of this invention to avoid the expense of providing and handling separate cover plates as are used in U.S. Pat. No. 3,280,525.

It is also a very important object of this invention to reduce the number of seals in the joinery between the adjacent concrete panels so that the chance of leakage from within the tank is reduced and the amount of sealant and the work necessary to apply that sealant is also reduced.

These and other objects of this invention are achieved in a prestressed concrete tank having a core wall comprising elongated panels of precast concrete having on their outer faces, a sheet of sheet metal presenting parallel, longitudinal, undercut channels. The panels also include two, lateral, sheet metal flanges which extend parallel with the elongated sides of the panels and laterally outwardly therefrom. The panels are assembled in spaced, side-by-side relationship such that the sheet metal flanges on adjacent panels overlap one another. The overlapping flanges are then fastened to one another, preferably with sheet metal screws and an elastomeric compound is used to seal the joint. The advantages of the instant invention are that the steel skin over the filler joints is part of the steel skin on the panels and a separate cover plate is not required. Moreover, when the concrete panels are erected, the joint cover is automatically in place except for sealing and this eliminates the problem of handling a separate cover plate. Also, there is only one joint line to seal with elastomeric compound versus two joint lines in the tank configuration of U.S. Pat. No. 3,280,525 and thus the amount of elastomeric material and labor that is required is reduced by about one half. The invention reduces the total joinery by one half and thereby reduces the change of leakage from the tank considerably.

Figure 2:
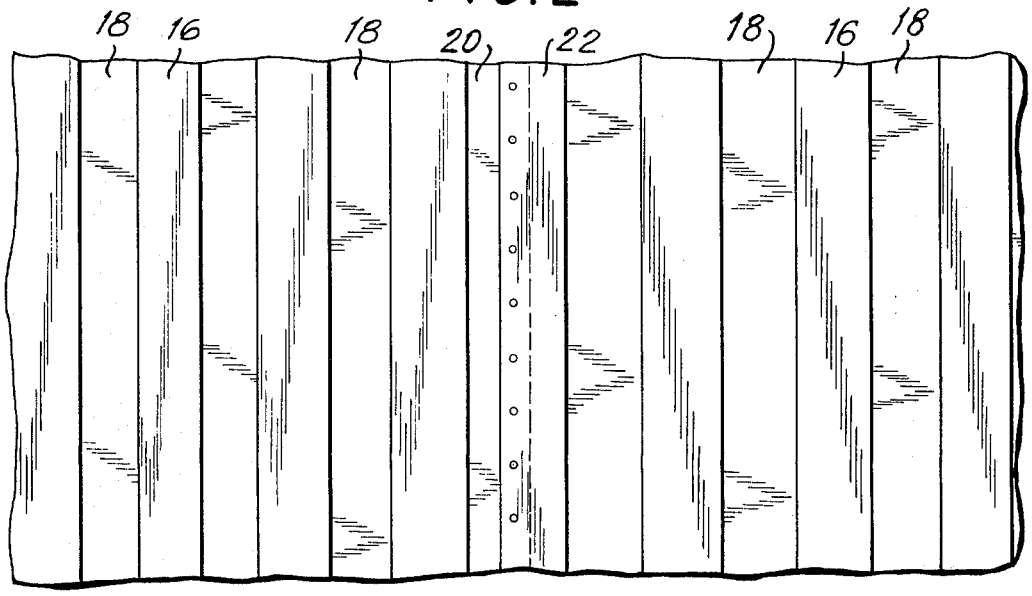
Figure 3:
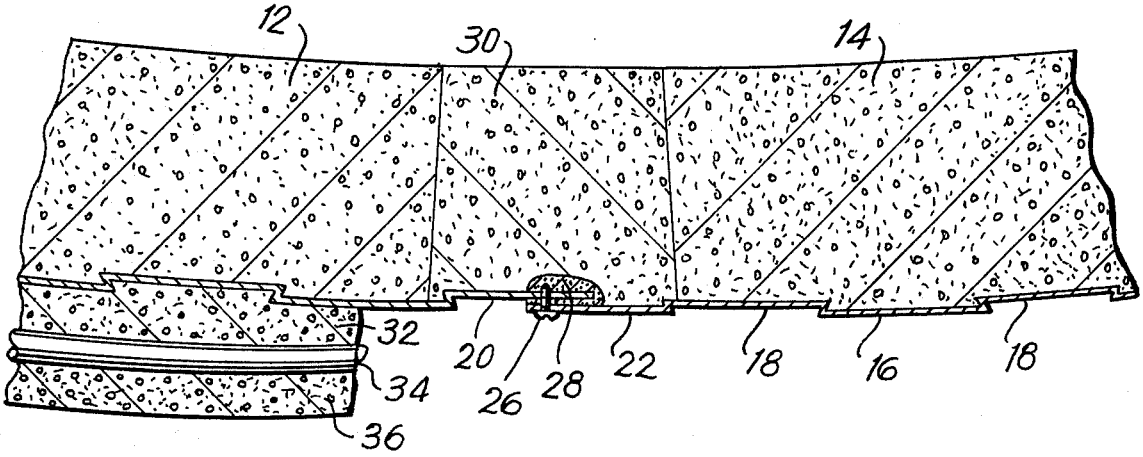

The invention is more fully described in the accompanying drawings, in which:

FIG. 1 is a cross sectional plan view of portions of the concrete tank of this invention showing the assembled panels; and FIG. 2 is an elevation view along lines 2—2 of FIG. 1; and FIG. 3 is a further cross sectional plan view of a completed tank according to the invention.

In FIG. 1, reference 10 refers generally to a concrete core wall formed from two precast concrete panels 12 and 14. Each of panels 12 and 14 has an outer face of sheet metal 16 which presents a plurality of parallel, longitudinal undercut channels 18. The steel sheet 16 on each of panels 12 and 14 extends past the edge of the panel to form a flange 20 on panel 12 and a flange 22 on panel 14. These flanges extend parallel with the vertical sides of panels 12 and 14 and extend laterally outwardly therefrom. Panels 12 and 14 are separated by space 24.

With reference to FIG. 2, flanges 20 and 22 on panels 12 and 14, respectively, overlap one another and are fastened to one another by means of sheet metal screws 26. The joint is filled with an elastomeric material 28 and the entire joint between panels 12 and 14 is filled with filler concrete 30. The elastomeric materials which are used to seal the joint may be any of those known for this purpose including silicone rubbers. polysulfides and the like.

After the core wall is erected as described, an intermediate wall 32 of cement is formed on the outer steel facing of the panels. Pneumatically projected mortar is used to form an outer coating or wall which tightly seals in the parallel, longitudinal, undercut channels 18 in the sheet metal facing of the panels. After the intermediate wall 32 is formed the tank may be prestressed by wires 34 and the wires are covered with a further cementitious covering 36.

What is claimed is:

1. A prestressed concrete tank having a core wall comprising elongated panels of precast concrete assembled in spaced, side-by-side relationship, each of said panels having on its outer face a sheet of sheet metal presenting parallel longitudinal undercut channels and two, lateral, sheet metal flanges extending parallel with the elongated sides of said panels and laterally outwardly therefrom, the sheet metal flanges overlapping the flanges of adjacent panels and being fastened thereto to form a joint between the side-by-side, spaced panels.

2. A prestressed concrete tank as recited in claim 1, wherein sheet metal screws are used to fasten the flanges on adjacent panels to one another to form said joint.

3. A prestressed concrete tank as recited in claim 2, wherein the said joints between adjacent panels are sealed with an elastomeric compound.

* * * * *